US005421074A

United States Patent [19]

Moore

[11] Patent Number: 5,421,074

[45] Date of Patent: * Jun. 6, 1995

[54] PICK PROOF DEADBOLT CONVERSION KIT

[76] Inventor: Orel R. Moore, 1162 Riverside Dr., Myrtle Creek, Oreg. 97457

[ * ] Notice: The portion of the term of this patent subsequent to Jul. 12, 2009 has been disclaimed.

[21] Appl. No.: 214,708

[22] Filed: Mar. 18, 1994

Related U.S. Application Data

[63] Continuation-in-part of Ser. No. 136,935, Oct. 18, 1993, Pat. No. 5,327,632.

[51] Int. Cl.[6] ..... E05B 13/08

[52] U.S. Cl. ..... 29/401.1; 70/93; 70/416; 292/150

[58] Field of Search ..... 70/416, 467, 468, 483, 70/93, 211, 429, 430; 292/150, 359, 264, 288, 289; 29/401.1

[56] References Cited

U.S. PATENT DOCUMENTS

| | | | |
|---|---|---|---|
| 999,127 | 7/1911 | Slivenick | 292/169.17 |
| 4,482,177 | 11/1984 | Nagy | 292/156 |
| 4,590,777 | 5/1986 | Sierra | 70/104 |
| 4,699,406 | 10/1987 | Swanson, Jr. | 292/175 |
| 4,830,558 | 5/1989 | Sweeney | 411/258 |
| 4,952,106 | 8/1990 | Kubogohi et al. | 411/48 |
| 5,000,498 | 3/1991 | Upchurch | 292/288 |
| 5,003,803 | 4/1991 | Richards | 70/416 |
| 5,052,202 | 10/1991 | Murphy | 70/211 |

FOREIGN PATENT DOCUMENTS

| | | | |
|---|---|---|---|
| 234780 | 7/1961 | Australia | 70/93 |
| 1913643 | 3/1969 | Germany | 70/93 |
| 185383 | 10/1936 | Switzerland . | |
| 1564607 | 4/1980 | United Kingdom | 292/359 |

*Primary Examiner*—Lloyd A. Gall
*Attorney, Agent, or Firm*—Richard C. Litman

[57] ABSTRACT

A conversion kit allows a user to convert a deadbolt lock mechanism into a pick proof deadbolt lock mechanism by providing all the necessary parts allowing a user to easily and effectively prevent the turnpiece latch of the deadbolt lock mechanism from rotating. Once installed, a locking shaft pin of the kit can be placed into a first orifice drilled through the turnpiece latch and a second orifice, coaxially aligned with the first orifice, drilled through the backplate to immobilize the turnpiece latch in its locked position. It would also allow a deadbolt manufacturer to use the same, in which case collars could be an O-ring style.

7 Claims, 3 Drawing Sheets

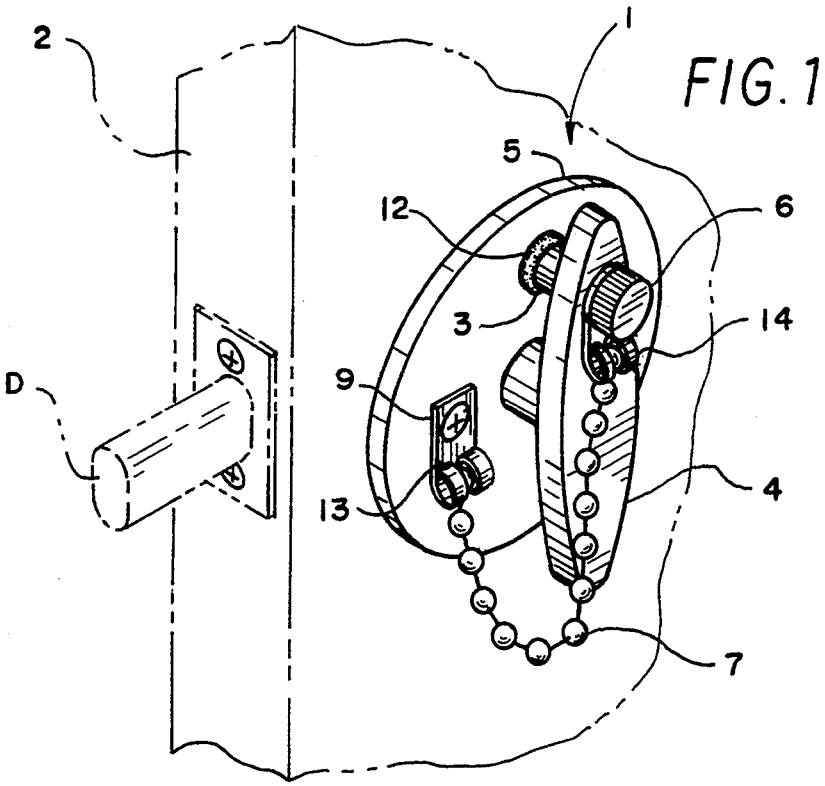
FIG. 1
FIG. 2
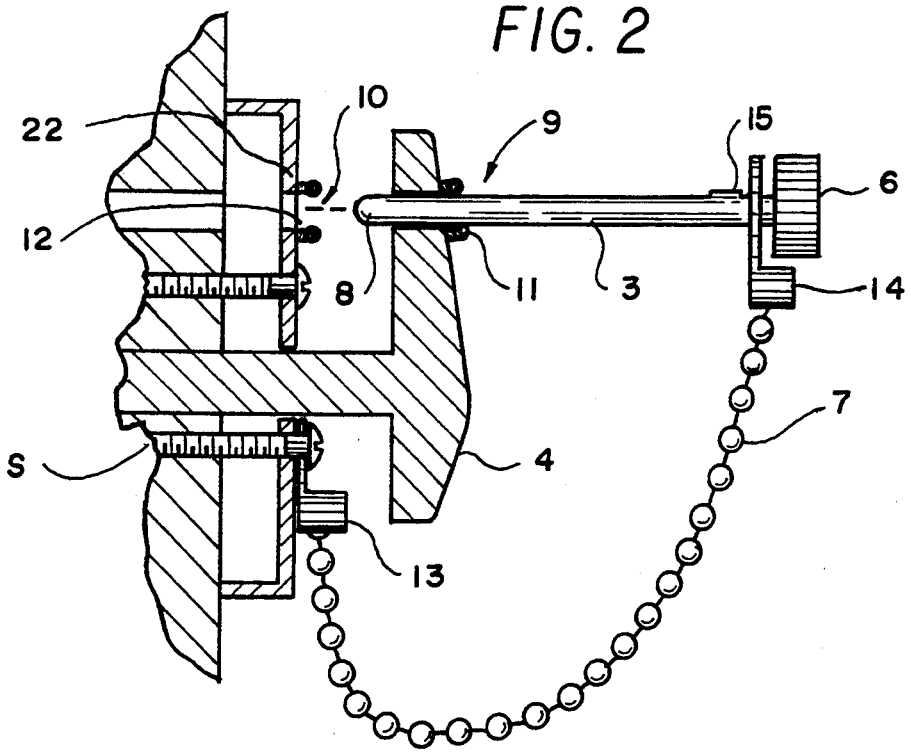

PICK PROOF DEADBOLT CONVERSION KIT

This is a continuation-in-part of application Ser. No. 08/136,935, filed on Oct. 18, 1993, now U.S. Pat. No. 5,327,632.

BACKGROUND OF THE INVENTION

1. Field of the Invention

The present invention primarily relates to single cylinder deadbolt locks installed on the doors of homes having the advantage of allowing a user inside the home to physically engage the latch with the backplate thereof when the deadbolt is latched, thereby preventing any would be intruder from entering the home by picking the lock. More particularly, the present invention pertains to a kit for modifying a single cylinder deadbolt lock found in most homes in order to provide the above mentioned advantage lacking in most single cylinder deadbolt locks. However, the same function may be applied at the manufacturing level.

2. Description of the Prior Art

Most deadbolt locks used in the average home are single cylinder locks having a key hole on the face of the lock located on the front side of the door and a latch on the opposite face side of the lock located on the back side of the door. Some of the deadbolt locks used in homes include a securing mechanism for preventing the latch from rotating from its locked position when the mechanism is engaged with the latch and some other object fixedly connected to the door. For example, U.S. Pat. No. 4,590,777, issued May 27, 1986 to Rafael Sierra, discloses a bolt lock which can be immobilized in the locked position.

A door latch is disclosed in U.S. Pat. No. 999,127, issued Jul. 25, 1911 to Joseph S. Slivenick, in which a screw having a knurled head is used to engage the bolt of the door latch.

A deadbolt locking device is disclosed in U.S. Pat. No. 5,052,202, issued Oct. 1, 1991 to Jerry A. Murphy. Murphy discloses a deadbolt locking device having a head portion including an aperture for engaging the latch of a deadbolt in the locked position as two leg portions engage the door handle to prevent the latch from rotating the head portion.

Means for preventing a deadbolt latch from rotating is disclosed in U.S. Pat. No. 5,003,803, issued Apr. 2, 1991 to Robert M. Richards, who discloses a plate having an aperture therethrough for allowing the latch of a deadbolt to fit therein. Once the latch is turned to the locked position, the plate is fit over the backplate and attached thereto with the latch being located within said aperture, thereby preventing the latch from rotating.

Another means for preventing a deadbolt latch from rotating is disclosed in U.S. Pat. No. 5,000,498, issued Aug. 3, 1990 to Lewis E. Upchurch. Upchurch discloses an adjustable clamp which can be fit over the latch and tightened down to securely clasp the latch. Once the latch is turned to its locked position, a sliding pin located at one end of the clamp can be slid into an aperture located on the door to prevent the latch from rotating.

A fastener for immobilizing a door handle once in the closed position is disclosed in U. K. Patent No. 1,564,607, issued Apr. 10, 1993 to Harry M. Williams.

Swiss Patent No. 185,383 issued Oct. 1, 1936 to Wilh. Schulte discloses a deadbolt lock arrangement having latch piece with an engaging member lockpost attached thereto for engaging the backplate once the latch is placed in its locked position.

None of the above inventions and patents, taken either singly or in combination, is seen to describe the instant invention as claimed.

SUMMARY OF THE INVENTION

The present invention primarily pertains to a kit for converting a single cylinder deadbolt lock assembly having at least a key hole on one face side thereof and a backplate and turnpiece latch on an opposite face side thereof into a pick proof lock assembly. The converted deadbolt lock assembly includes a locking shaft pin for preventing the turnpiece latch from rotating when the locking shaft pin is engaged by placing it through an aperture located through the latch and an aperture located through the backplate, wherein the aperture through the latch and backplate are coaxially aligned with one another. In this manner, a user at home can engage the locking shaft pin in order to prevent the latch from rotating, thereby preventing any would be intruder from unlocking the latch by picking the lock.

The kit of the present invention includes a locking shaft pin attached to a first end of a chain. A second end of the chain opposite the first end includes another fastener. This other fastener may be attached to the backplate of the deadbolt lock by simply unscrewing one of the screws thereof and inserting the screw through the other fastener before placing the screw back on the backplate. In this manner the locking shaft pin hangs down from the backplate through the use of the chain until it is ready to be used.

After the locking shaft pin is connected to the backplate, a user simply has to place the deadbolt lock in its locked position, e.g., extending the bolt of the lock to engage the door jamb, and then drilling a hole through the turnpiece latch and a hole through the backplate so that the two holes axially line up as the deadbolt is in its locked position. In the preferred embodiment, two collars are included in the kit to be place into the two drilled holes. In this manner, the locking shaft pin may be inserted into the apertures through the two collars so as to provide a proper fit of the locking shaft pin into the holes drilled through the turnpiece latch and backplate, thereby immobilizing the turnpiece latch so as to prevent any would be intruder from picking the deadbolt lock.

Accordingly, it is a principal object of the invention to provide a kit for converting a typical single cylinder deadbolt lock into a pick proof deadbolt lock while a user is at home.

It is another object of the invention to provide such a kit which can be easily installed into any deadbolt lock assembly by the homeowner.

Still another object of the invention is to provide a pick proof mechanism for a deadbolt latch assembly which is simple to use and has few moving parts.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 1 is an environmental perspective view of the device of the present invention.

FIG. 2 is a cross-sectional view of the present invention with the locking shaft pin inserted within the aperture drilled through the turnpiece latch.

Similar reference characters denote corresponding features consistently throughout the attached drawings.

DETAILED DESCRIPTION OF THE PREFERRED EMBODIMENT

Figure 3:
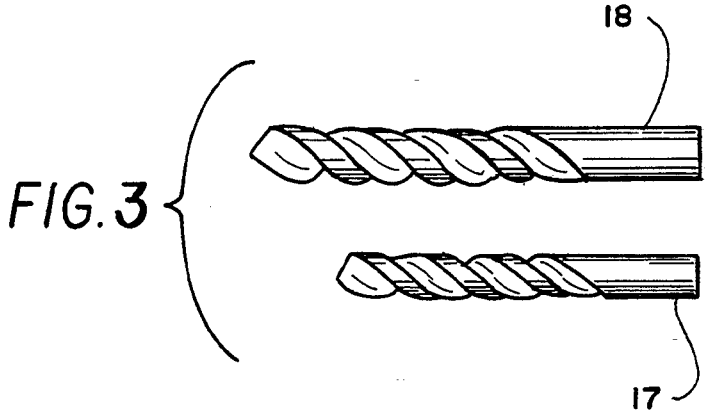
FIG. 3 illustrates the drill bits optionally used within the kit of the present invention.

FIG. 1 illustrates a deadbolt lock mechanism 1 used on a door 2 and converted to be a pick proof lock mechanism after the kit of the present invention was employed therewith. As illustrated therein, a locking shaft pin 3 is placed into an orifice through the turnpiece latch 4 and the backplate 5 in order to prevent the deadbolt lock mechanism from being unlocked. The locking shaft pin 3 has a flanged head 6 at one end for allowing a user to grasp the pin 3 for easy removal from and placement into the orifices located through the turnpiece latch 4 and the backplate 5. While not in use, the locking shaft pin hangs down from a chain 7 connected to the backplate 5.

As illustrated in FIG. 2, the locking shaft pin 3 has a rounded end 8 opposite the end having the flanged head 6 attached thereto. With the deadbolt lock assembly 1 placed in its locked position in which a deadbolt D (shown in FIG. 1) extends outward from the door 2, the user has only to slip the locking shaft pin 3 into a first orifice 9 drilled through the turnpiece latch 4 for engagement therewith and a second orifice 10 drilled through the backplate 5 for engagement therewith for preventing the turnpiece latch 4 from rotating as a key hole (not shown) located on the front side of the door 2 is operated.

In the preferred embodiment, two collars 11 and 12 are attachable about the orifices 9 and 10, respectively, for providing a snug fit about the locking shaft pin 3. Each of the collars 11 and 12 have an aperture therethrough having an inner diameter substantially equivalent to the outer diameter of the locking shaft pin 3. The outer diameter of each of the collars 11 and 12 is large enough to provide suitable surface area to support adhesive. In this manner, the locking shaft pin is maintained by a friction fit within the orifices 9 and 10 once inserted therein. The frictional fit is sufficient to prevent the locking shaft pin from slipping out of the orifices 9 and 10 due to vibrations, for example, caused by operating a key inside the key hole of the deadbolt lock mechanism 1. The frictional fit can not be so great as to prevent the locking shaft pin 3 from being manually removed from the orifices 9 and 10 in case of emergency.

As illustrated in FIGS. 1 and 2, the chain 7 is connected to the backplate 5 via a screw S of the deadbolt lock assembly 1 attaching a fastener 13 connected to one end of the chain 7. Connected to the other end of the chain 7, is another fastener 14 located around the locking shaft pin 3. A raised portion 15 prevents the fastener 14 from slipping off the locking shaft pin 3. The kit of the present invention includes the chain 7 attached to the locking shaft pin 3 and the fasteners 13 and 14 (see FIG. 4). The kit also includes the two collars 11 and 12. With a minimum amount of effort and required skill, the user can convert any deadbolt lock assembly 1 into a pick proof lock following the procedures discussed below.

Figure 4:
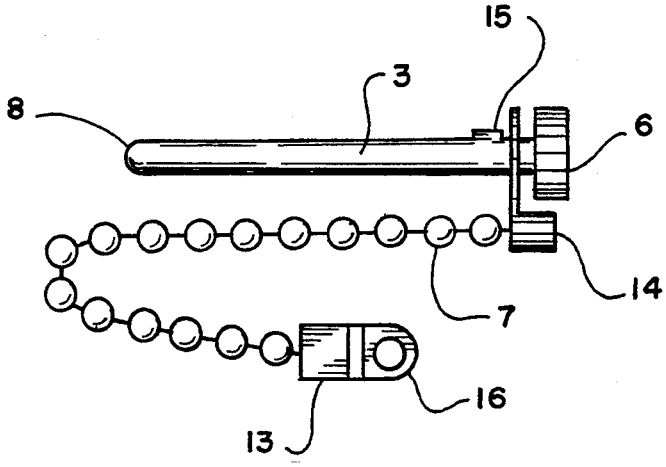
FIG. 4 is a side view of the locking shaft pin having the chain attached thereto.

As illustrated in FIG. 3, the kit of the present invention further may include one or more drill bits for the consumer. A kit for a locksmith would simply include the two collars 11 and 12 and the locking shaft pin 3 and attachments thereto as illustrated in FIG. 4. The procedure for installing the kit of the present invention into a deadbolt lock mechanism 1 would be the same. A screw S located on the backplate 5 would have to be unscrewed and inserted into a orifice 16 of the fastener 13 before being reinserted into the backplate 5. After the turnpiece latch 4 is rotated so as to place the deadbolt lock mechanism 1 in its locked position, an orifice 9 is drilled through the turnpiece latch and another orifice 10 is drilled through the backplate 5. In the preferred embodiment, an initial orifice is drilled through the turnpiece latch 4 and the backplate 5 with a pilot drill bit 17 having a smaller diameter than the orifices 9 and 11. Afterwards, the larger drill bit 18 is used to drill the orifices 9 and 10. The orifices 9 and 10 are coaxially aligned with the initial orifices drilled through the turnpiece latch and backplate, as well as with each other.

Figure 5:
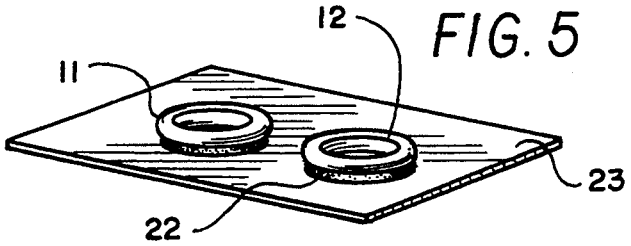
FIG. 5 is a perspective view of the collars.
Figure 6:
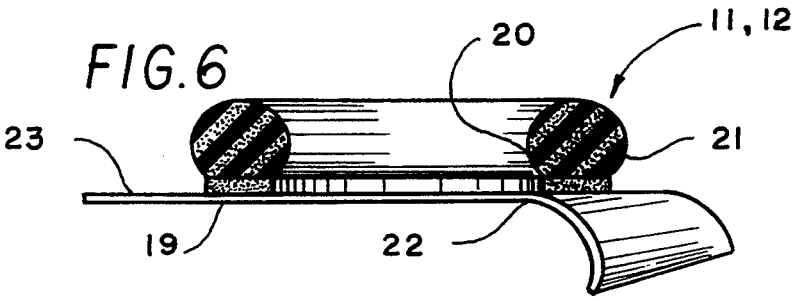
FIG. 6 is a cross-sectional view of a collar shown in FIG. 5.

FIGS. 5 and 6 illustrate the details of the construction of the identically constructed collars 11 and 12. The collar 11 is a substantially O-shaped ring having a surface area 19 bounded between an inner and outer diameter 20 and 21. This surface area 19 is intended to support an adhesive 22. As the locking shaft pin 3 is inserted therein, the inner diameter 20 engages the locking shaft to hold it in place. The collars 11 and 12 are provided on a release sheet 23. The collars 11 and 12 are lifted from the release sheet 23 to expose the adhesive coating 22.

Figure 7:
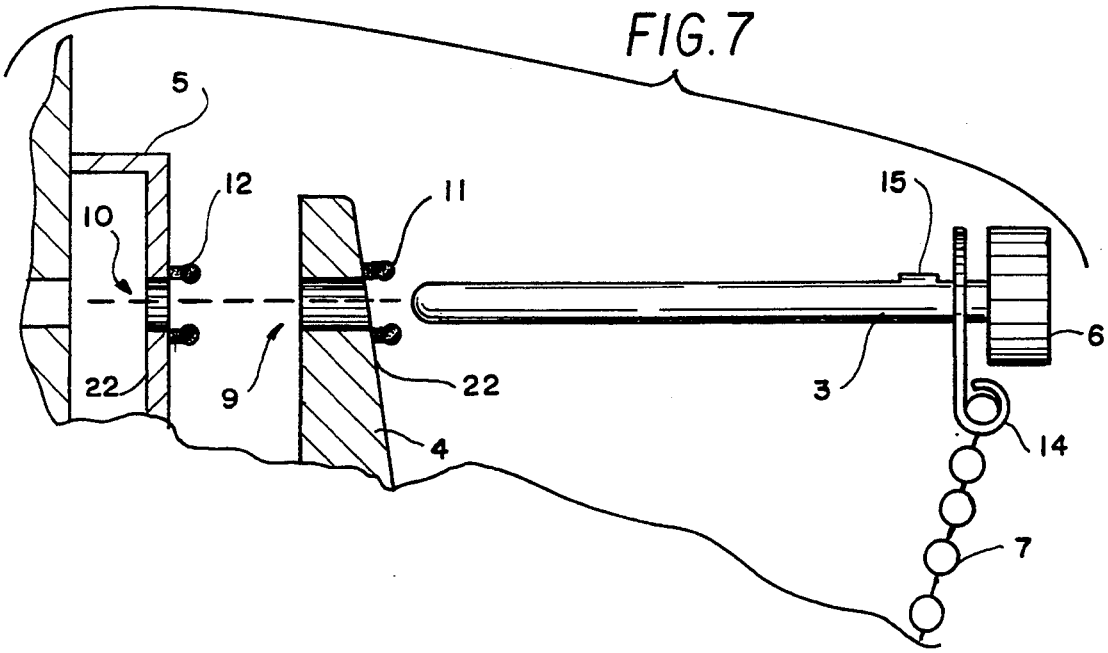
FIG. 7 is a partial cross-sectional view of a converted deadbolt lock before the locking shaft pin is inserted into the turnpiece latch and deadbolt backplate.
Figure 8:
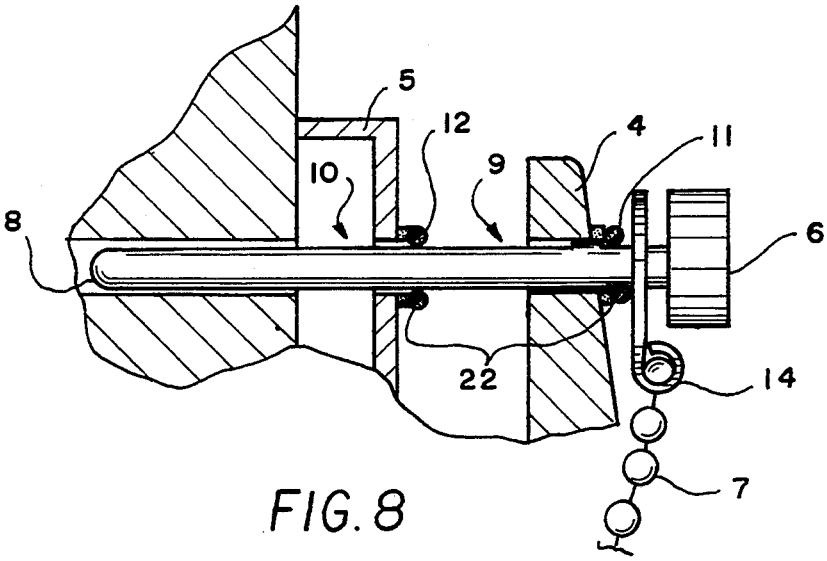
FIG. 8 is a partial cross-sectional view of a converted deadbolt lock with the locking shaft pin inserted into the turnpiece latch and deadbolt backplate.

As shown in FIGS. 2, 7, and 8, the collars 11 and 12 are attached to the turnpiece latch and deadbolt backplate 4 and 5. As the locking shaft pin 3 is inserted into the apertures of the collars 11 and 12, it frictionally engages the inner diameter walls of the collars 11 and 12. However, the locking shaft pin 3, does not engage the inner walls of the collars 11 and 12 in a tight fit. This is important in case of emergency in which occupants must leave quickly, such as in the case of a fire. The locking shaft pin 3 must not become stuck inside the collars so that it can be pulled out quickly with ease. FIG. 8 illustrates the locking shaft pin 3 inserted into both of the collars 11 and 12. The locking shaft pin 3 is easily removed therefrom and has no engaging parts to get stuck therein.

It is to be understood that the present invention is not limited to the sole embodiment described above, but encompasses any and all embodiments within the scope of the following claims.

I claim:

1. A method of converting a deadbolt lock assembly having at least a key hole on a first face side thereof, a backplate and a turnpiece latch on a second side thereof into a pick proof lock by preventing the turnpiece latch from turning once a locking shaft pin is engaged to connect the backplate and turnpiece latch, said method comprising the steps of:

attaching a tether having the locking shaft pin at a first end thereof to the backplate by securing a fastener attached at a second end thereof opposite the first end thereof to a screw located on the backplate;

placing a deadbolt lock of a single cylinder deadbolt lock assembly in a locked position;

drilling a first engaging orifice of a predetermined diameter through the turnpiece latch after placing the deadbolt lock in a locked position;

drilling a second engaging orifice having the same predetermined diameter as the first engaging orifice through the backplate after drilling the first engaging orifice through the turnpiece latch so that the first engaging orifice and the second engaging orifice are coaxially aligned;

applying a first collar on the turnpiece latch having an inner diameter substantially equivalent to the predetermined diameter of the first engaging orifice; and applying a second collar on the backplate having an inner diameter substantially equivalent to the predetermined diameter of the second engaging orifice;

wherein the locking shaft pin may be engaged to connect the turnpiece latch and the backplate by placing the locking shaft pin through a first aperture located through the first collar, the locking shaft pin having an outer diameter substantially equivalent to the inner diameter of the first collar for providing a frictional fit therethrough, and then placing said locking shaft pin through a second aperture located through the second collar, the locking shaft pin also having an outer diameter substantially equivalent to the inner diameter of the second collar for providing a frictional fit therethrough, thus preventing said turnpiece latch from turning once the deadbolt lock is placed in the locked position.

2. A conversion kit for converting a deadbolt lock assembly having at least a key hole on a first face side thereof and a backplate and turnpiece latch on a second side thereof, said conversion kit comprising:

a locking shaft pin having a first end and a second end;

a tether having a first end and a second end;

a first fastener attached to said first end of said tether;

a second fastener attached to said second end of said tether and engaging said locking shaft pin proximate to said first end;

securing means for preventing said second fastener from moving beyond a predetermined distance from said first end of said locking shaft pin towards said second end; and a plurality of collars, one for reception on each of the backplate and turnpiece latch, each of said collars having an aperture therethrough of substantially the same diameter as the diameter of the locking shaft pin, and each of said collars including an adhesive surface.

3. A conversion kit for converting a deadbolt lock assembly as claimed in claim 2, further comprising a first drill bit having a diameter substantially the same as an inner diameter of each of said collars.

4. A conversion kit for converting a deadbolt lock assembly as claimed in claim 2, wherein said securing means includes a flanged head located at said first end of said locking shaft pin and a raised portion located on said locking shaft pin a predetermined distance from said flange.

5. A conversion kit for converting a single cylinder deadbolt lock assembly having at least a key hole on a first face side thereof and a backplate and turnpiece latch on a second side thereof, said conversion kit comprising:

a locking shaft pin having a rounded end at one end thereof and a flanged head at an opposite end thereof;

a chain having a first end and a second end;

a first fastener attached to said first end of said chain;

a second fastener attached to said second end of said chain and engaging said locking shaft pin proximate to said flanged head;

securing means for preventing said second fastener from moving beyond a predetermined distance from said flanged head towards said rounded end; and a plurality of collars, one for reception on each of the backplate and turnpiece latch, each of said collars having an aperture therethrough of substantially the same diameter as the diameter of the locking shaft pin, and each of said collars including an adhesive surface.

6. A conversion kit for converting a single cylinder deadbolt lock assembly as claimed in claim 5, further comprising a first drill bit having a diameter substantially the same as an inner diameter of each of said collars.

7. A conversion kit for converting a single cylinder deadbolt lock assembly as claimed in claim 5, wherein said securing means includes a raised portion located on said locking shaft pin said predetermined distance from said flanged head towards said rounded end.

* * * * *